US008281631B1

(12) United States Patent
Chen

(10) Patent No.: US 8,281,631 B1
(45) Date of Patent: Oct. 9, 2012

(54) CORRUGATED METAL SHEET MEMBER FABRICATION SYSTEM

(76) Inventor: Chun-Liang Chen, Hsien (TW)

( * ) Notice: Subject to any disclaimer, the term of this patent is extended or adjusted under 35 U.S.C. 154(b) by 528 days.

(21) Appl. No.: 12/612,119

(22) Filed: Nov. 4, 2009

(51) Int. Cl.
*B21C 37/12* (2006.01)
*B21F 11/00* (2006.01)

(52) U.S. Cl. ..... 72/178; 72/181; 72/337; 72/379.2; 72/379.6; 83/319; 83/320; 29/564.6; 29/564.8; 29/895.3

(58) Field of Classification Search ..... 72/49, 176–183, 72/130, 186, 336, 339, 379.2, 379.6; 83/326, 83/318, 319, 320; 29/564.6, 564.8, 895.3, 29/421.1
See application file for complete search history.

(56) References Cited

U.S. PATENT DOCUMENTS 4,092,842 A * 6/1978 Oser et al. ..... 72/379.6
4,250,728 A * 2/1981 King ..... 72/177
4,346,576 A * 8/1982 Sivachenko ..... 72/186
4,434,638 A * 3/1984 Sivachenko ..... 72/186
7,040,001 B1 * 5/2006 Chuang ..... 29/564
7,189,195 B1 * 3/2007 Chuang ..... 72/454

* cited by examiner

*Primary Examiner* — David B Jones
(74) *Attorney, Agent, or Firm* — Jackson IPG PLLC

(57) ABSTRACT

A corrugated metal sheet member fabrication system formed of a material feeder, a roller-ramming unit, a cutting unit, a conveyer, and a finished product receiving rack is disclosed. When the reciprocating cutting-off device is moved forwards or backwards, the belt frame of the conveyer is synchronously moved to carry the movable frames forwards or backwards, and therefore the front driven roller and the rear driven roller with the conveying belt are moved with the movable frames forwards to the extended position or backwards to the retrieved position. After the movable frames has been moved forwards, the front side of the conveying belt is kept spaced above the base for receiving finished products from the reciprocating cutting-off device of the cutting unit and delivering collected finished products to the finished product receiving rack. Therefore, the invention automatically and accurately conveys finished products from the reciprocating cutting-off device of the cutting unit to the finished product receiving rack.

8 Claims, 16 Drawing Sheets

CORRUGATED METAL SHEET MEMBER FABRICATION SYSTEM

BACKGROUND AND SUMMARY OF THE INVENTION

The present invention relates to a corrugated metal sheet member fabrication system and more particularly, to an improved structure of corrugated metal sheet member fabrication system, in which the cutting-off device synchronously carry two movable frames of the conveyer forwards or backwards so that the front side of the conveying belt is kept spaced above the base for receiving finished products from the reciprocating cutting-off device of the cutting unit and delivering collected finished products to the finished product receiving rack when the movable frames is moved forwards to the extended position. Therefore, the invention automatically and accurately conveys finished products from the reciprocating cutting-off device of the cutting unit to the finished product receiving rack, and prohibits finished products from falling to the ground.

A conventional corrugated metal sheet member/tile fabrication machine is known comprising a material feeder for feeding a metal sheet material, a roller-ramming unit for ramming the metal sheet material received from the material feeder into a corrugated metal sheet material, and a cutting unit for cutting the corrugated metal sheet material into finished corrugated metal sheet members for further delivery by a conveyer. According to this design, the worker must stop the finished product conveying conveyer before each corrugated metal sheet material cutting operation. This fabrication procedure is complicated and the fabrication speed is low, i.e., this machine is not allowed for competition to enter the market.

FIG. 1 illustrates another design of conventional corrugated metal sheet member fabrication system for making corrugated metal sheets or metal tiles. During operation of this structure of corrugated metal sheet member fabrication system, metal sheet material 90 is delivered from a material feeder 91 to a roller-ramming unit 92 and roller-rammed into a corrugated form by the roller-ramming unit 92, and the corrugated metal sheet material is then properly cut by a cutting-off device 931 of a cutting unit 93 into corrugated metal sheet members subject to the desired size, and the finished products are then delivered one after another to a finished product receiving rack 95 by a conveyer 94. The cutting-off device 931 of the cutting unit 93 is supported on a base 932 and can be reciprocated forwards and backwards on the base 932 by a screw transmission mechanism subject to the operation speed of the roller-ramming unit 92 (see also FIG. 2). Therefore, the worker needs not to stop the cutting-off device 931 of the cutting unit 93 during the operation of the roller-ramming unit 92. However, this structure of corrugated metal sheet member fabrication system is still not satisfactory in function. Because the cutting-off unit 931 is movable along sliding rails 9321 at the top side of the base 932, the front side 941 of the conveyer 94 is kept spaced from the roller-ramming unit 92 at a distance 96 (see FIG. 1) after the cutting-off device 931 has reached to the front limit position, and short finished products may fall to the ground accidentally and not accurately be collected by the conveyer. When this happens, the worker must shut down the system.

Therefore, it is desirable to provide a corrugated sheet member fabrication system, which eliminates the aforesaid problem.

The present invention has been accomplished under the circumstances in view. According to one aspect of the present invention, the corrugated metal sheet member fabrication system comprises a material feeder, a roller-ramming unit, a cutting unit, a conveyer, and a finished product receiving rack.

When the reciprocating cutting-off device is moved forwards or backwards, the belt frame of the conveyer is synchronously moved to carry the movable frames forwards or backwards, and therefore the front driven roller and the rear driven roller with the conveying belt are moved with the movable frames forwards to the extended position or backwards to the retrieved position. After the movable frames has been moved forwards, the front side of the conveying belt is kept spaced above the base for receiving finished products from the reciprocating cutting-off device of the cutting unit and delivering collected finished products to the finished product receiving rack. Therefore, the invention automatically and accurately conveys finished products from the reciprocating cutting-off device of the cutting unit to the finished product receiving rack.

According to another aspect of the present invention, the corrugated metal sheet member fabrication system achieves fabrication of corrugated metal sheet members automatically, ensuring accurate delivery of finished products from the reciprocating cutting-off device of the cutting unit to the finished product receiving rack and preventing falling of finished products from the conveyer.

According to still another aspect of the present invention, the position of the front driven roller that is pivotally provided at the front side of the movable frames is conveniently adjustable relative to the movable frames to satisfy different working requirements.

DETAILED DESCRIPTION OF THE INVENTION

Figure 1:
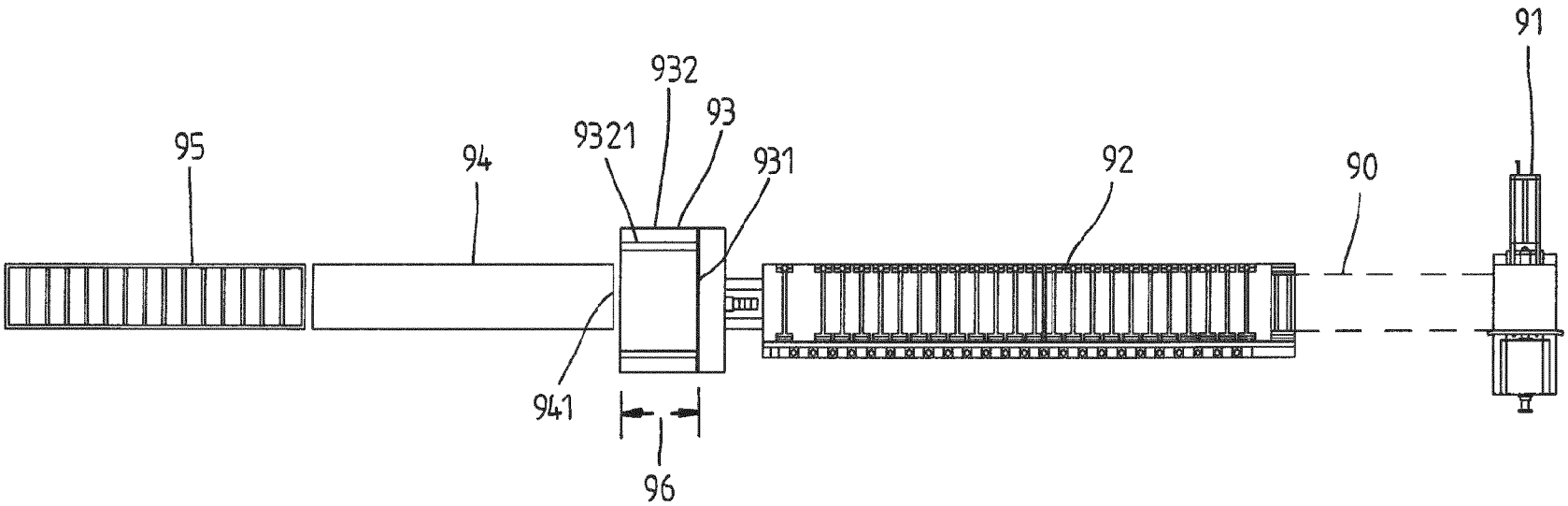
Fig. 1 PRIOR ART
FIG. 1 is a schematic top plain view of a corrugated metal sheet member fabrication system according to the prior art.
Figure 2:
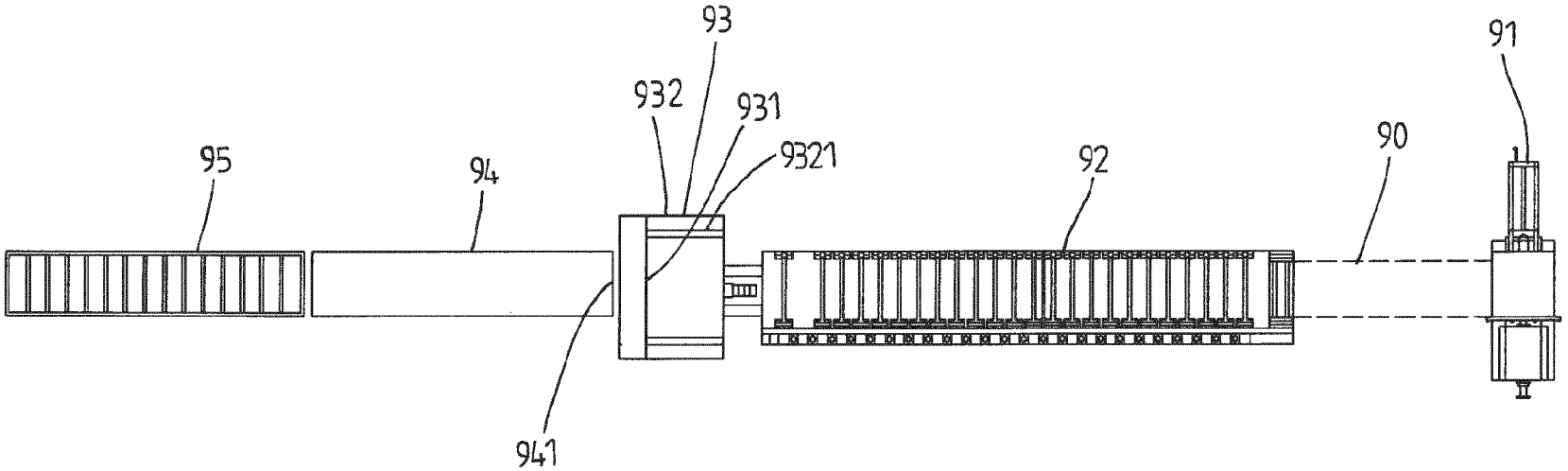
Fig. 2 PRIOR ART
FIG. 2 corresponds to FIG. 1 but showing the cutting-off device moved backwards.
Figure 3:
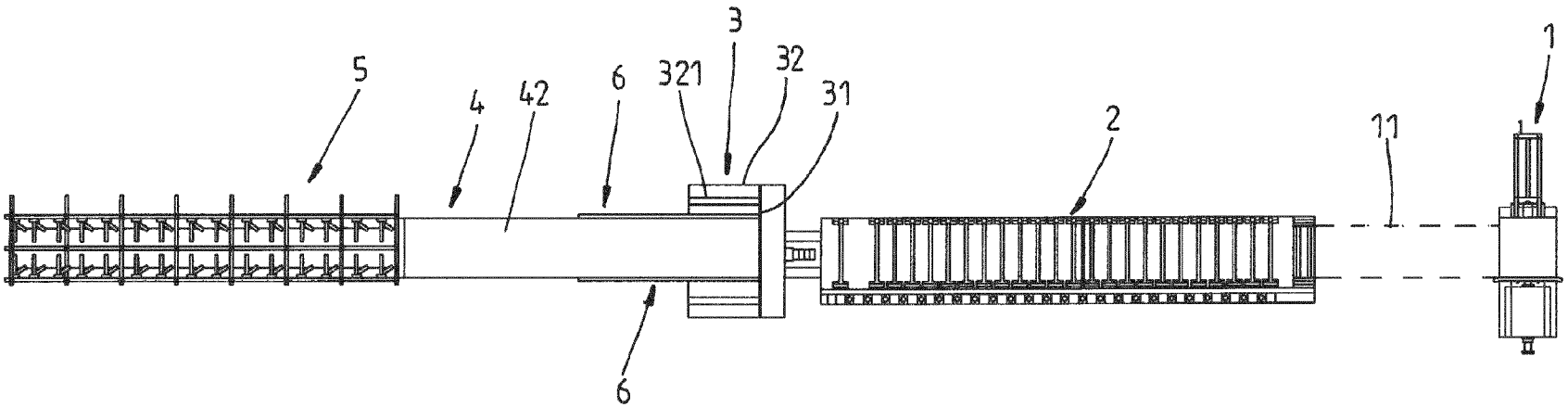
FIG. 3 is a schematic top plain view of a part of a corrugated metal sheet member fabrication system in accordance with the present invention, showing the reciprocating cutting-off device moved with the movable frames and the conveying belt to the front side.
Figure 4:
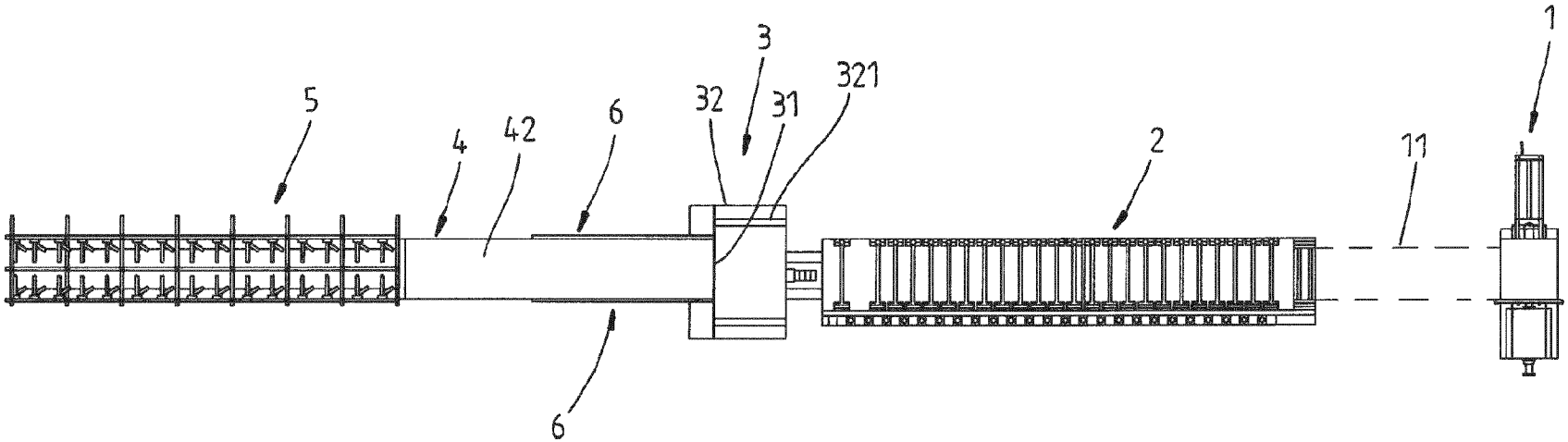
FIG. 4 corresponds to FIG. 3, showing the reciprocating cutting-off device moved with the movable frames and the conveying belt to the rear side.

Referring to FIGS. 3-16, a corrugated metal sheet member fabrication system in accordance with the present invention is shown comprised of a material feeder 1 (see FIG. 3), a roller-ramming unit 2, a cutting unit 3, a conveyer 4, and a finished product receiving rack 5. Metal sheet material 11 is delivered from the to the roller-ramming unit 2 and roller-rammed into a corrugated form by the roller-ramming unit 2, and then the corrugated metal sheet material 11 is properly cut by a reciprocating cutting-off device 31 of the cutting unit 3 into corrugated metal sheet members subject to the desired size, and then the finished products are delivered one after another to the finished product receiving rack 5 by a conveying belt 42 at a belt frame 41 of the conveyer 4. The reciprocating cutting-off device 31 of the cutting unit 3 has two sliding grooves 311 arranged in parallel on the bottom wall and respectively coupled to two sliding rails 321 at a base 32 (see FIG. 5). The reciprocating cutting-off device 31 is driven to move forwards/backwards along the sliding rails 321 by a screw transmission mechanism (not shown).

The main features of the present invention are described hereinafter.

Figure 5:
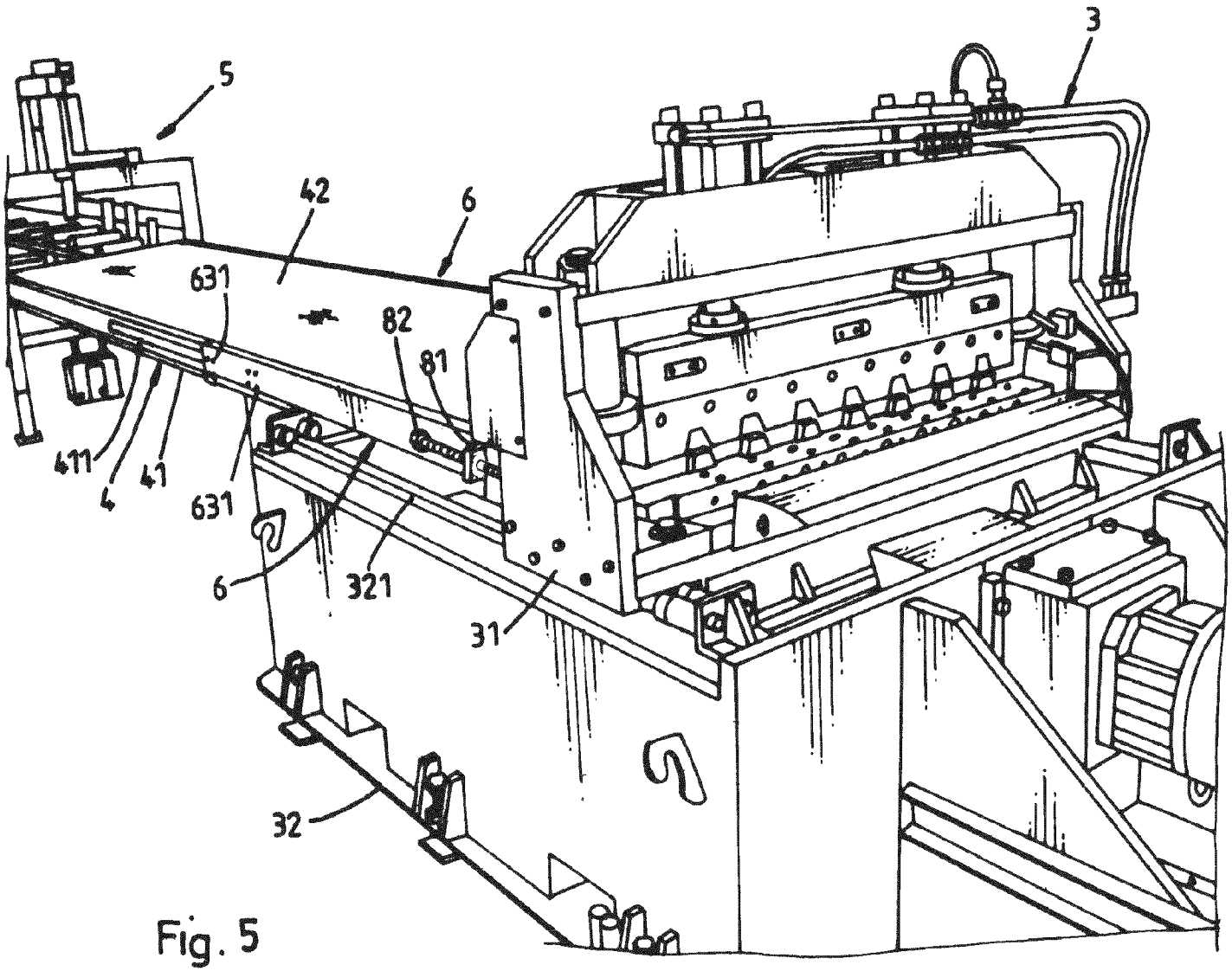
FIG. 5 is an elevational view of a part of the corrugated metal sheet member fabrication system in accordance with the present invention.
Figure 6:
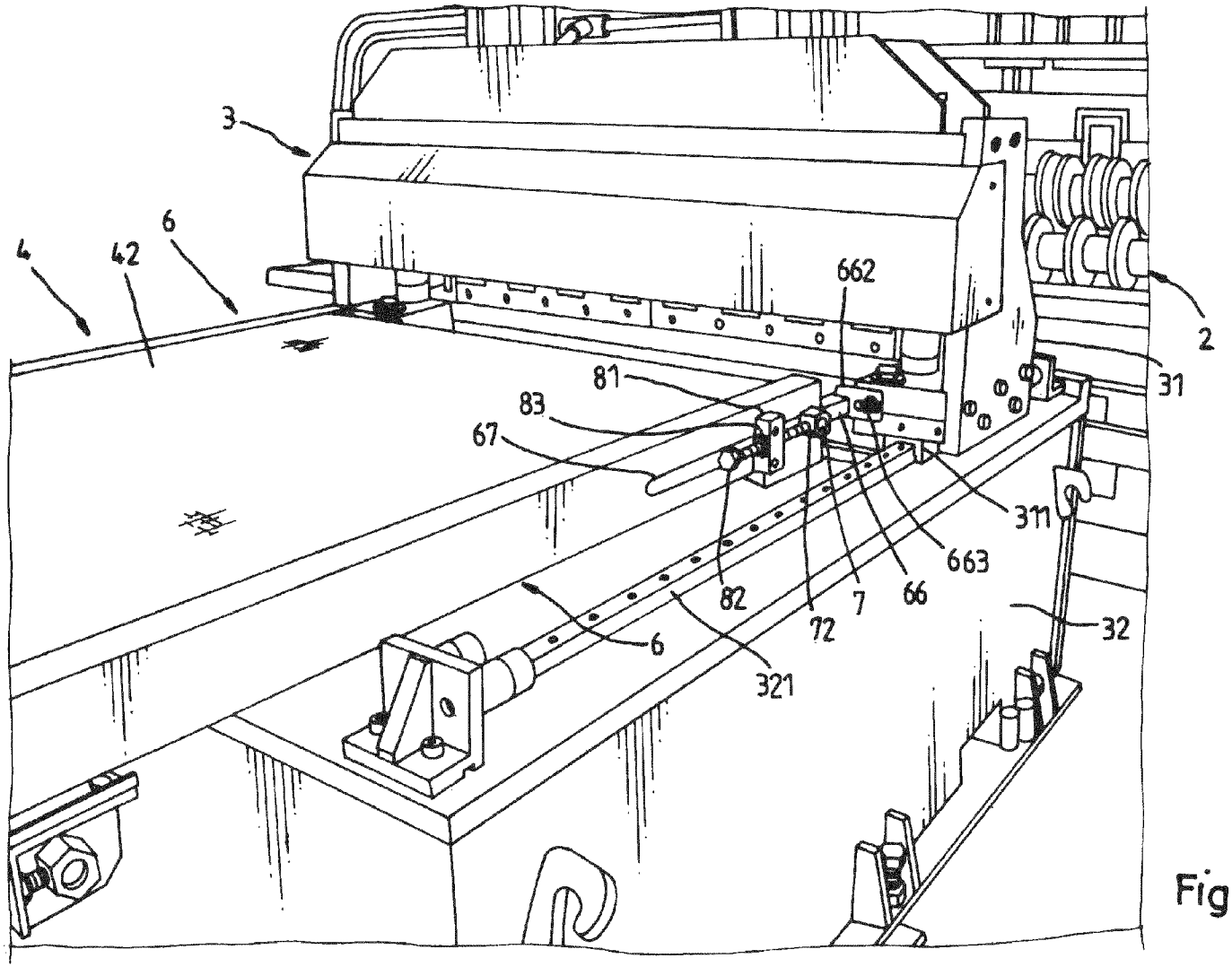
FIG. 6 is an elevational view of another part of the corrugated metal sheet member fabrication system in accordance with the present invention.

The left and right ends of the back side of the cutting-off device 31 of the cutting unit 3 are respectively connected to the front ends of two movable frames 6 (see FIG. 6). The two movable frames 6 are respectively slidably arranged along two opposite sides of the belt frame 41 of the conveyer 4. A front driven roller 61 is pivotally connected between the front ends of the movable frames 6 (see FIGS. 12, 15 and 16). A rear driven roller 62 is pivotally connected between the rear ends of the movable frames 6 (see FIGS. 9 and 15). The belt frame 41 of the conveyer 4 has a driven roller 43 pivotally provided at its front side and spaced between the front driven roller 61 and rear driven roller 62 at a relatively lower elevation. The conveying belt 42 of the conveyer 4 extends over the driven roller 43 at the front side of the belt frame 41 (see FIGS. 15 and 16), the front driven roller 61 and rear driven roller 62 at the movable frames 6, and a driving roller 44 at the rear side of the belt frame 41. When the driving roller 44 is rotated by a transmission mechanism (not shown), the conveying belt 42 is moved to deliver the finished products to the finished product receiving rack 5. When the cutting-off device 31 of the cutting unit 3 is moved forwards (see FIGS. 5 and 15) or backwards (see FIGS. 14 and 16), the movable frames 6 are moved synchronously, and therefore the conveying belt 42 is moved with the movable frames 6 forwards (to the extended position) or backwards (to the retrieved position). When the movable frames 6 are moved forwards, the front side of the conveying belt 42 is kept spaced above the base 32 for receiving finished products from the reciprocating cutting-off device 31 of the cutting unit 3 and delivering collected finished products to the finished product receiving rack 5. Therefore, the invention automatically and accurately conveys finished products from the reciprocating cutting-off device 31 of the cutting unit 3 to the finished product receiving rack 5.

Figure 9:
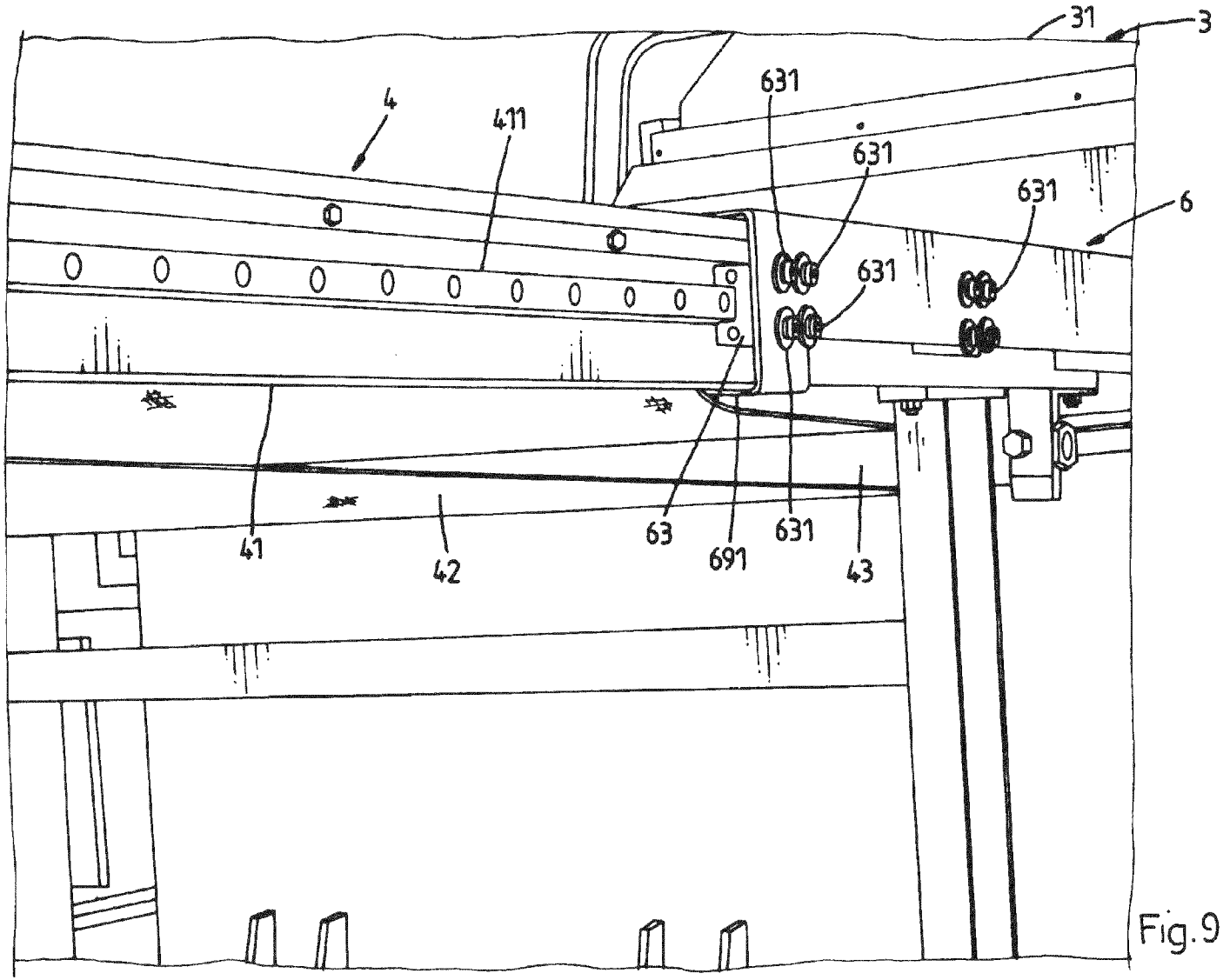
FIG. 9 is an elevational view of still another part of the corrugated metal sheet member fabrication system in accordance with the present invention.
Figure 10:
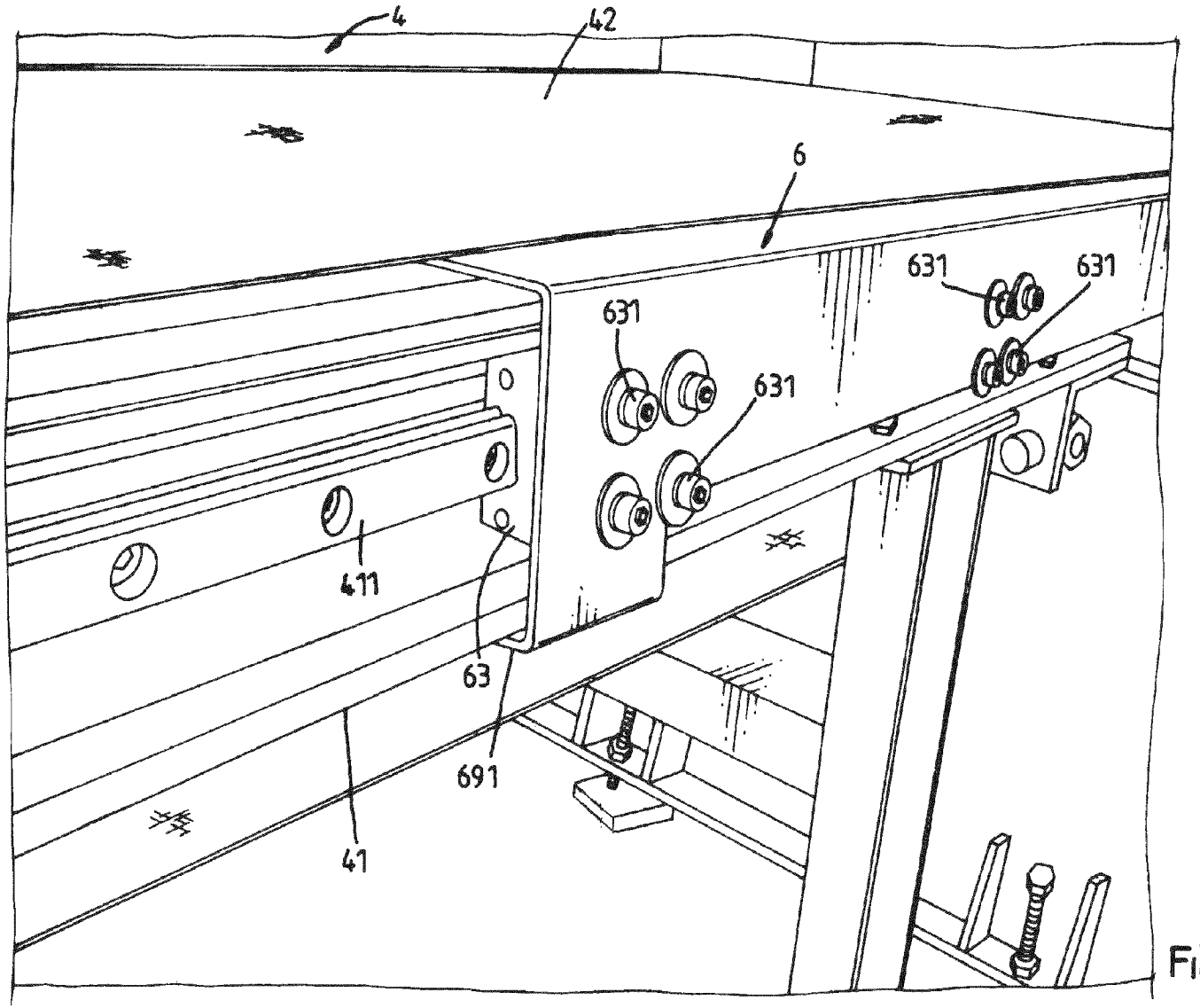
FIG. 10 is an elevational view of still part of the corrugated metal sheet member fabrication system in accordance with the present invention.

Referring to FIGS. 9 and 10, the belt frame 41 of the conveyer 4 has two rails 411 arranged on its two opposite lateral sides and respectively coupled to two track members 63 that are respectively affixed to the movable frames 6 with fastening members 631.

Referring to FIG. 5, the belt frame 41 of the conveyer 4 is disposed above the elevation of the top side of the two sliding rails 321 at the base 32 of the cutting unit 3 so that the movable frames 6 with the front driven roller 61 and the rear driven roller 62 are kept spaced above the base 32 of the cutting unit 3 when the conveying belt 42 is moved with the movable frames 6 forwards to the extended position.

Referring to FIGS. 8, 13, 15 and 16, the belt frame 41 of the conveyer 4 is mounted with two brackets 46 to support a driven roller 45 between the driven roller 43 at the front side of the belt frame 41 and the driving roller 44 at a relatively lower elevation to stretch the conveying belt 42, controlling the tension of the conveying belt 42.

Figure 12:
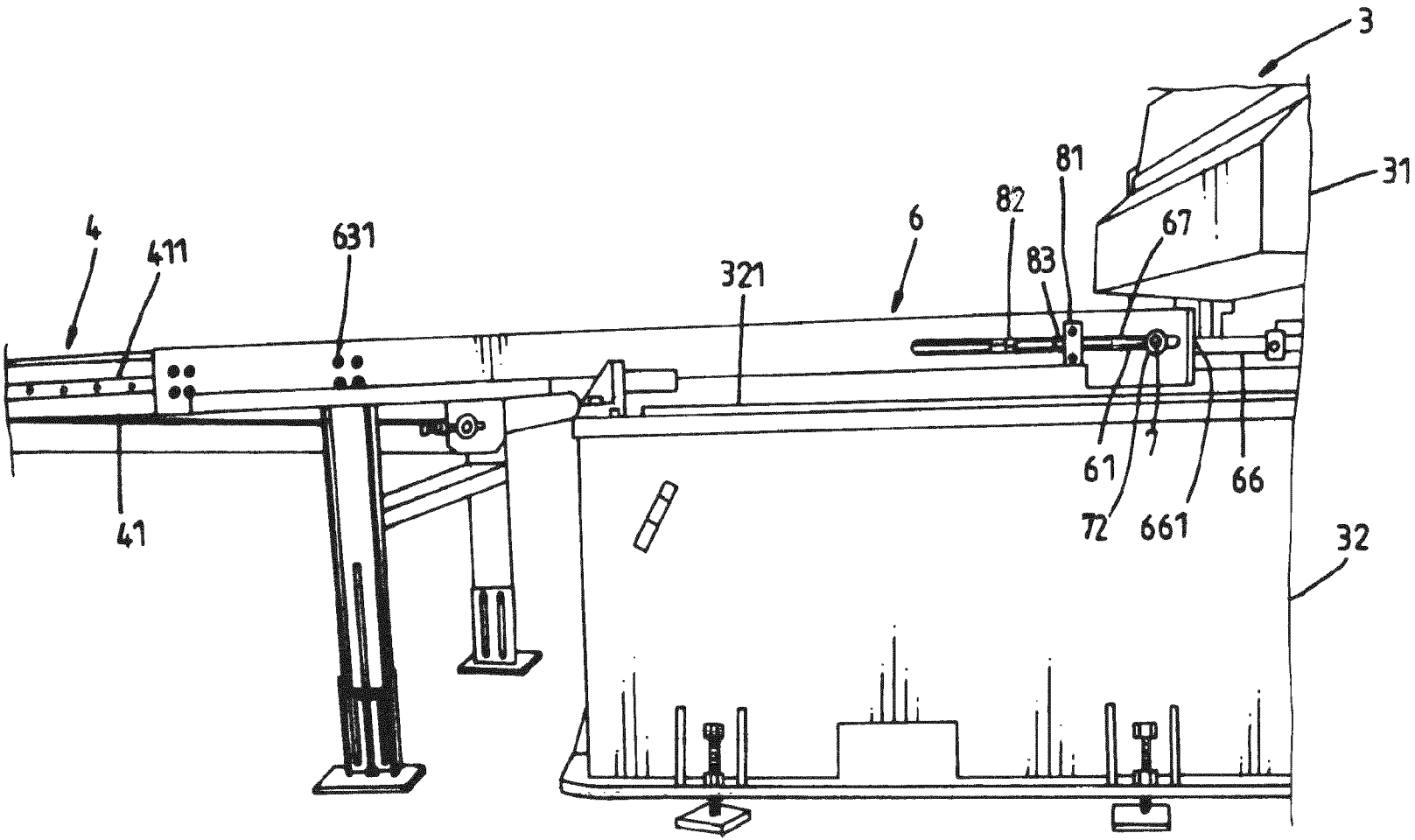
FIG. 12 is an elevational view of still part of the corrugated metal sheet member fabrication system in accordance with the present invention.
Figure 13:
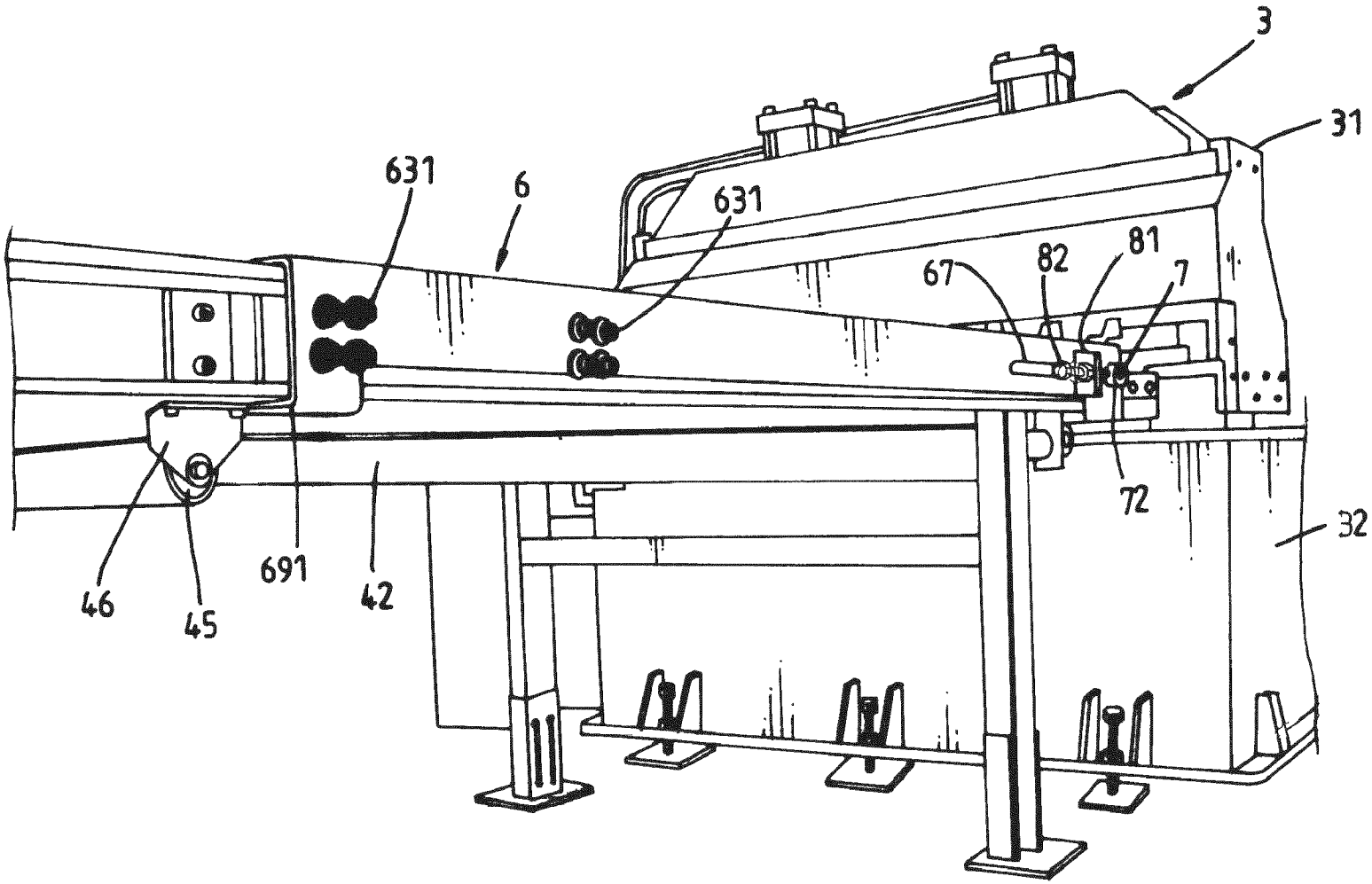
FIG. 13 is an elevational view of still another part of the corrugated metal sheet member fabrication system in accordance with the present invention, showing the reciprocating cutting-off device moved with the movable frames and the conveying belt backwards.
Figure 14:
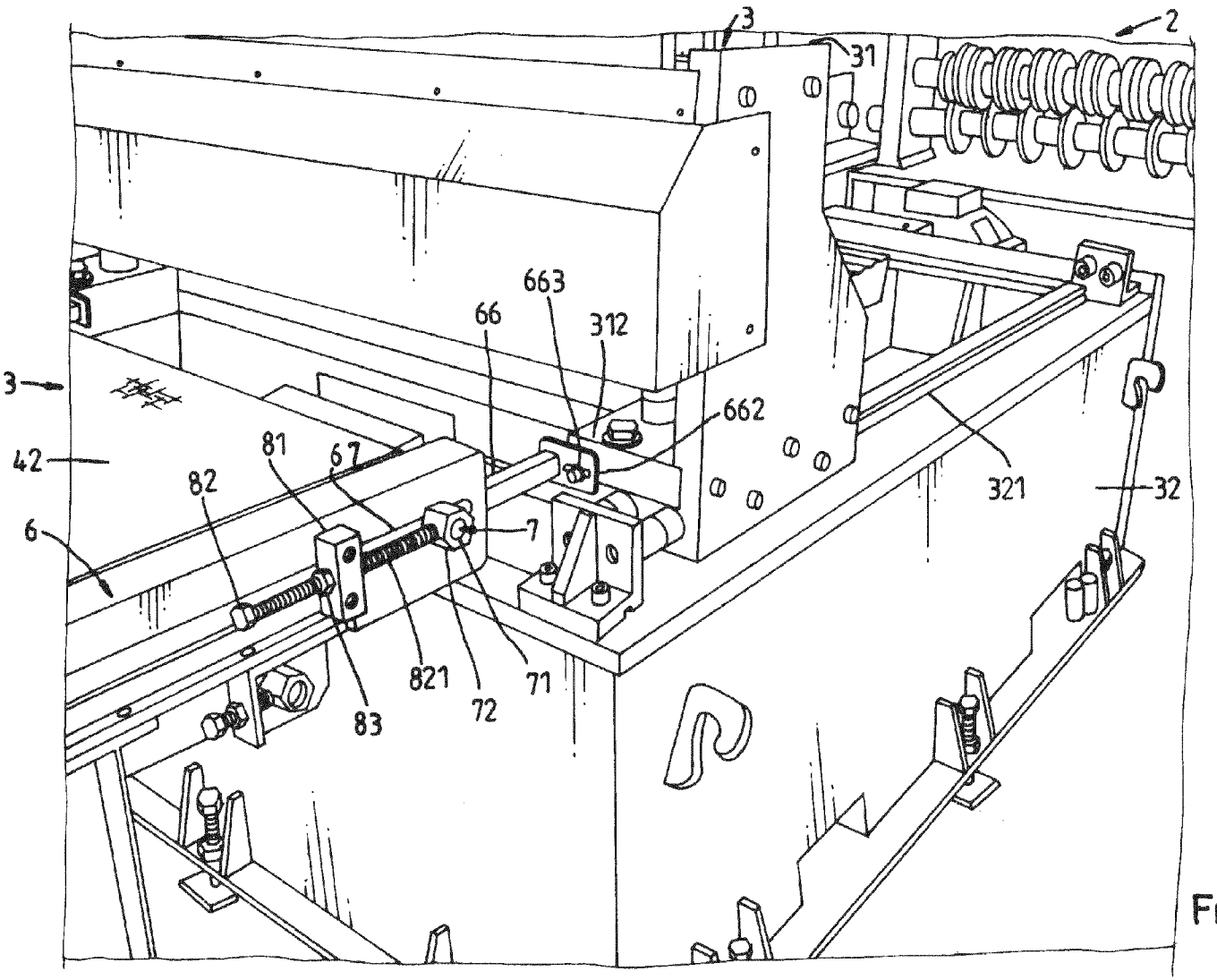
FIG. 14 is an oblique top view in an enlarged scale of a part of FIG. 13.
Figure 15:
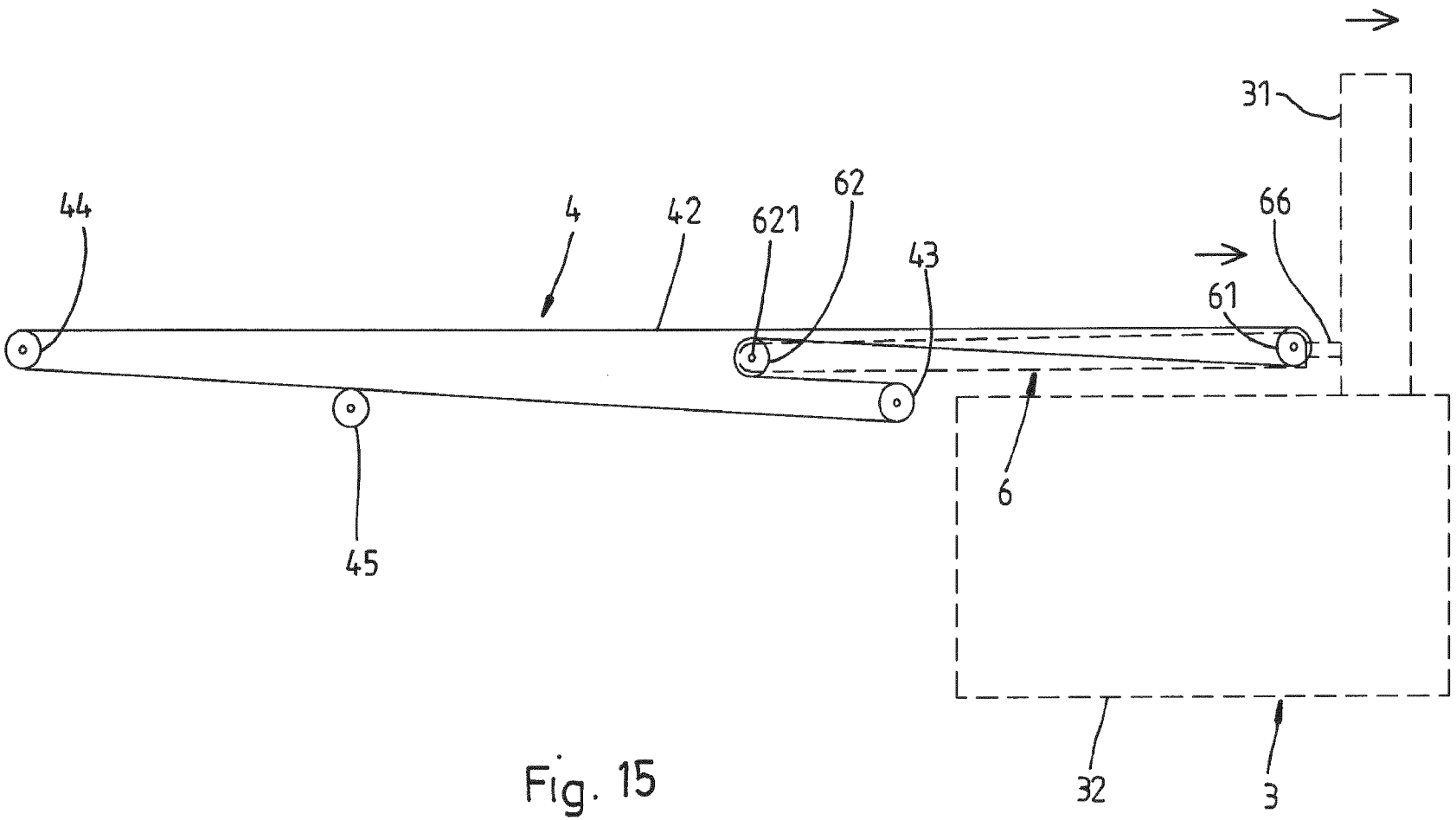
FIG. 15 is a schematic side plain view of the present invention, showing the reciprocating cutting-off device moved with the movable frames and the conveying belt forwards.
Figure 16:
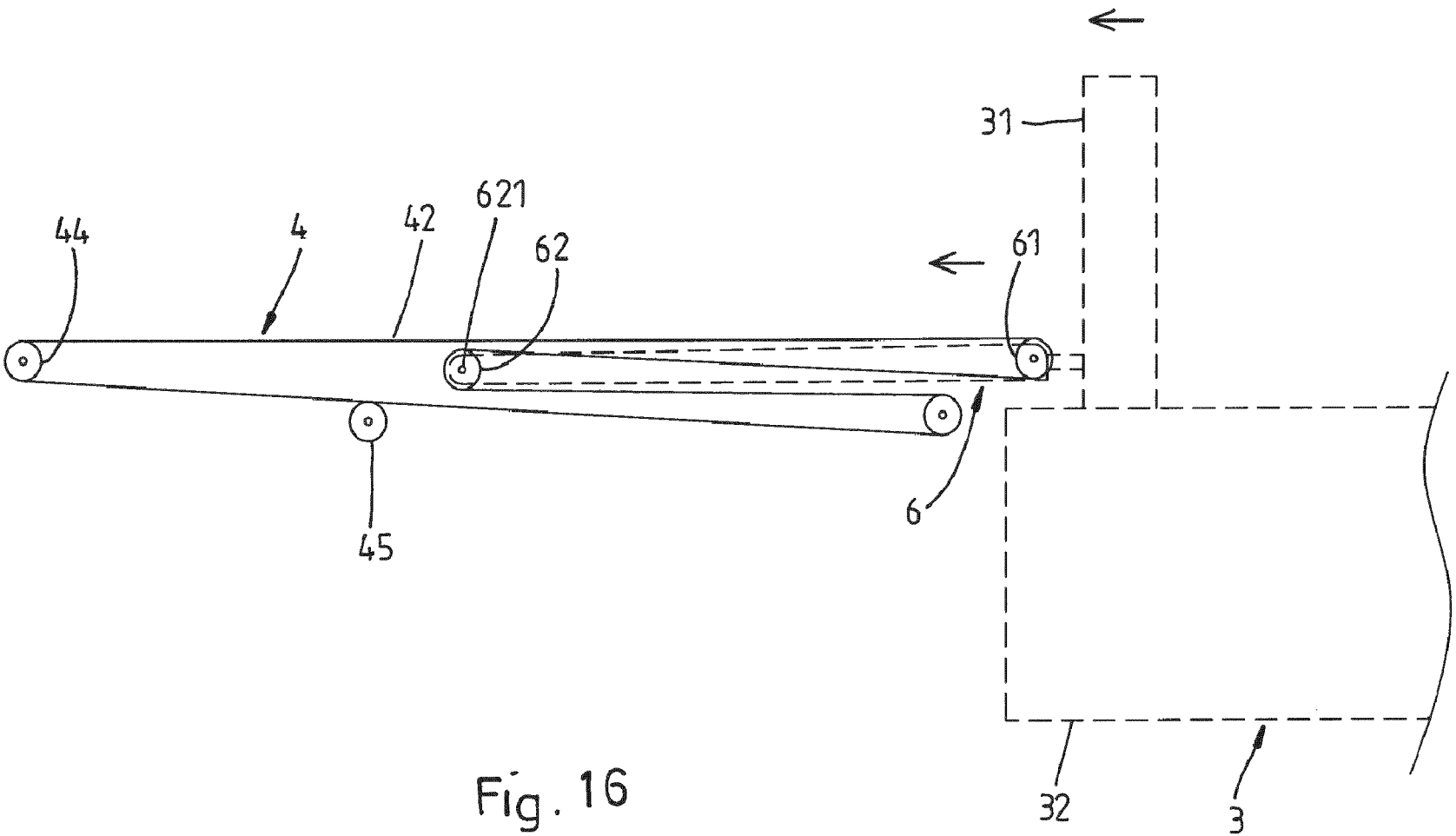
FIG. 16 is a schematic side plain view of the present invention, showing the reciprocating cutting-off device moved with the movable frames and the conveying belt backwards.

Referring to FIG. 12, the front ends of the two movable frames 6 are respectively connected to the rear ends 661 of two connecting members 66. The front ends 662 of the connecting members 66 are respectively fastened to rear left and right portions 312 of the reciprocating cutting-off device 31 of the cutting unit 3 by a respective fastening member 663 (see FIG. 7).

Figure 7:
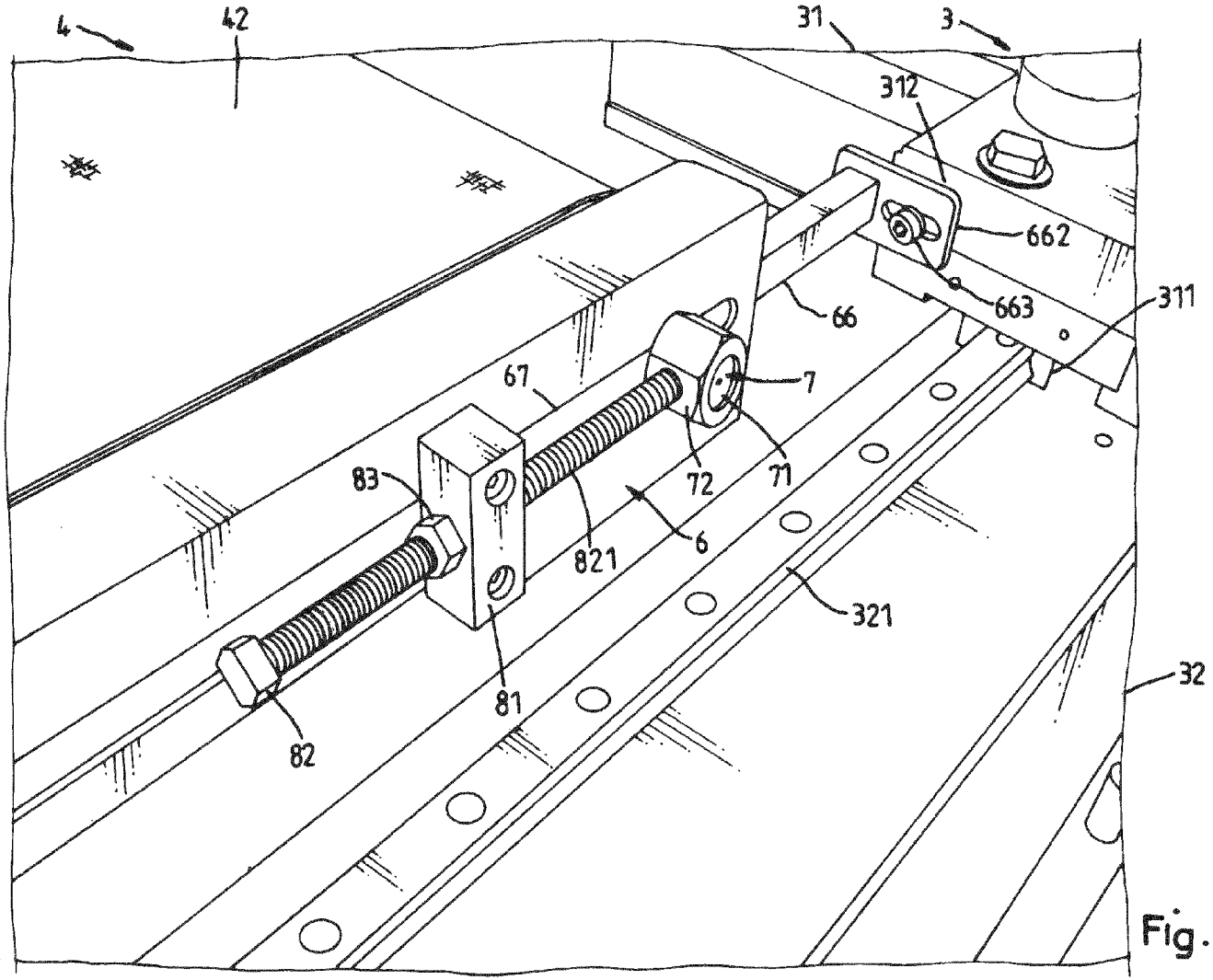
FIG. 7 is an elevational view of still another part of the corrugated metal sheet member fabrication system in accordance with the present invention.
Figure 8:
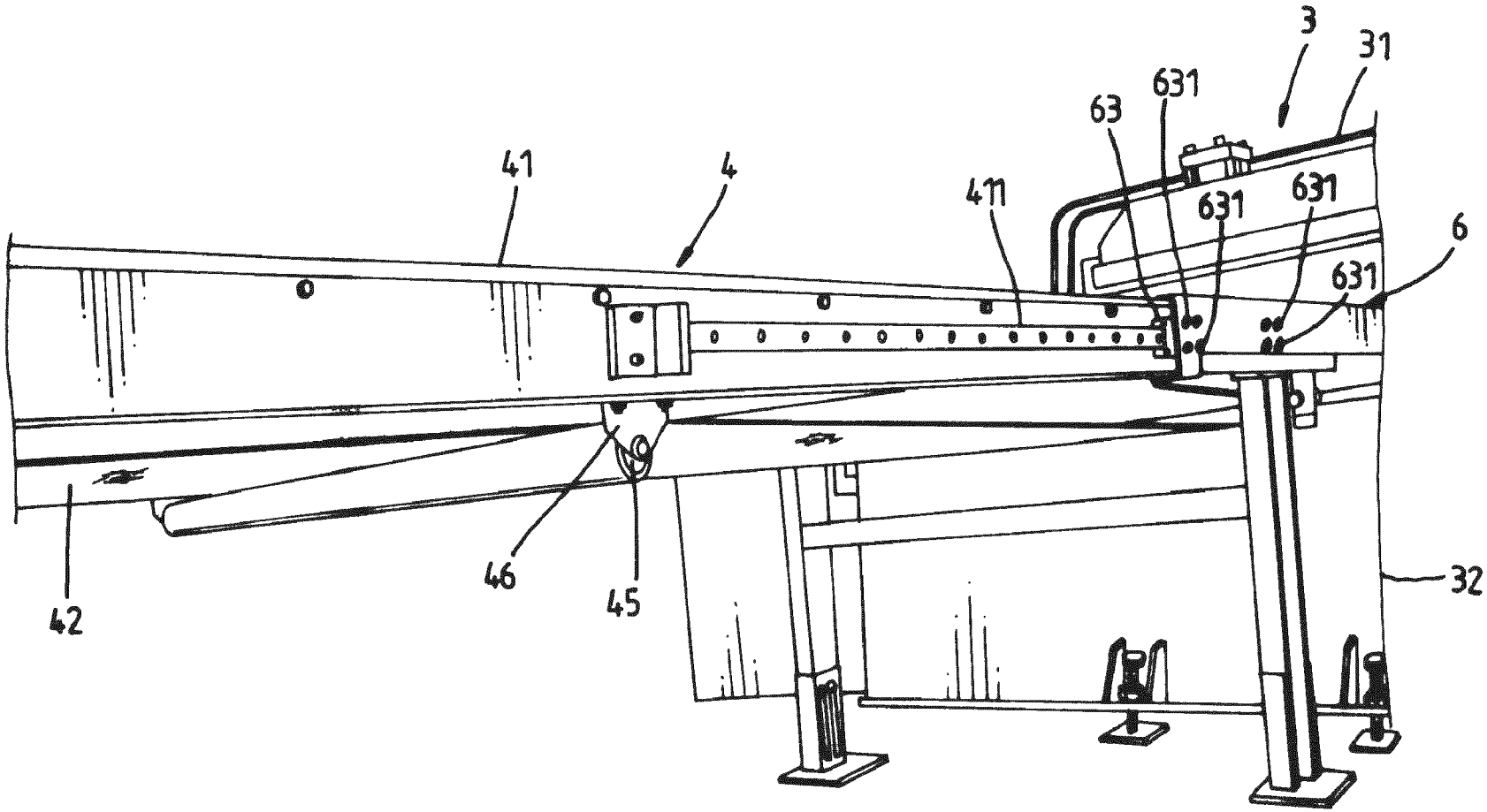
FIG. 8 is an elevational view of still another part of the corrugated metal sheet member fabrication system in accordance with the present invention.

Referring to FIG. 7, the movable frames 6 each have a longitudinally extending front sliding slot 67, and a pivot shaft 7 is coupled to the longitudinally extending front sliding slots 67 of the movable frame 6 to pivotally support the front driven roller 61 between the movable frames 6. Two lock nuts 72 are respectively threaded onto the two threaded ends 71 of the pivot shaft 7 and stopped against the movable frames 6 to lock the pivot shaft 7 to the movable frames 6. Each movable frame 6 is fixedly mounted with a locating block 81. An adjustment screw 82 is mounted with a packing nut 83 and installed in the locating block 81 at each movable frame 6. The distal end of the threaded shank 821 of the adjustment screw 82 is stopped against the periphery of the lock nut 72 at the associating movable frame 6. The packing nut 83 is threaded onto the threaded shank 821 of the associating adjustment screw 82 and stopped against the associating locating block 81. When loosened the packing nuts 83, the adjustment screws 82 can be rotated to adjust the position of the pivot shaft 7 relative to the longitudinally extending front sliding slots 67 of the movable frame 6, and therefore the position of the front driven roller 61 is relatively adjusted.

Figure 11:
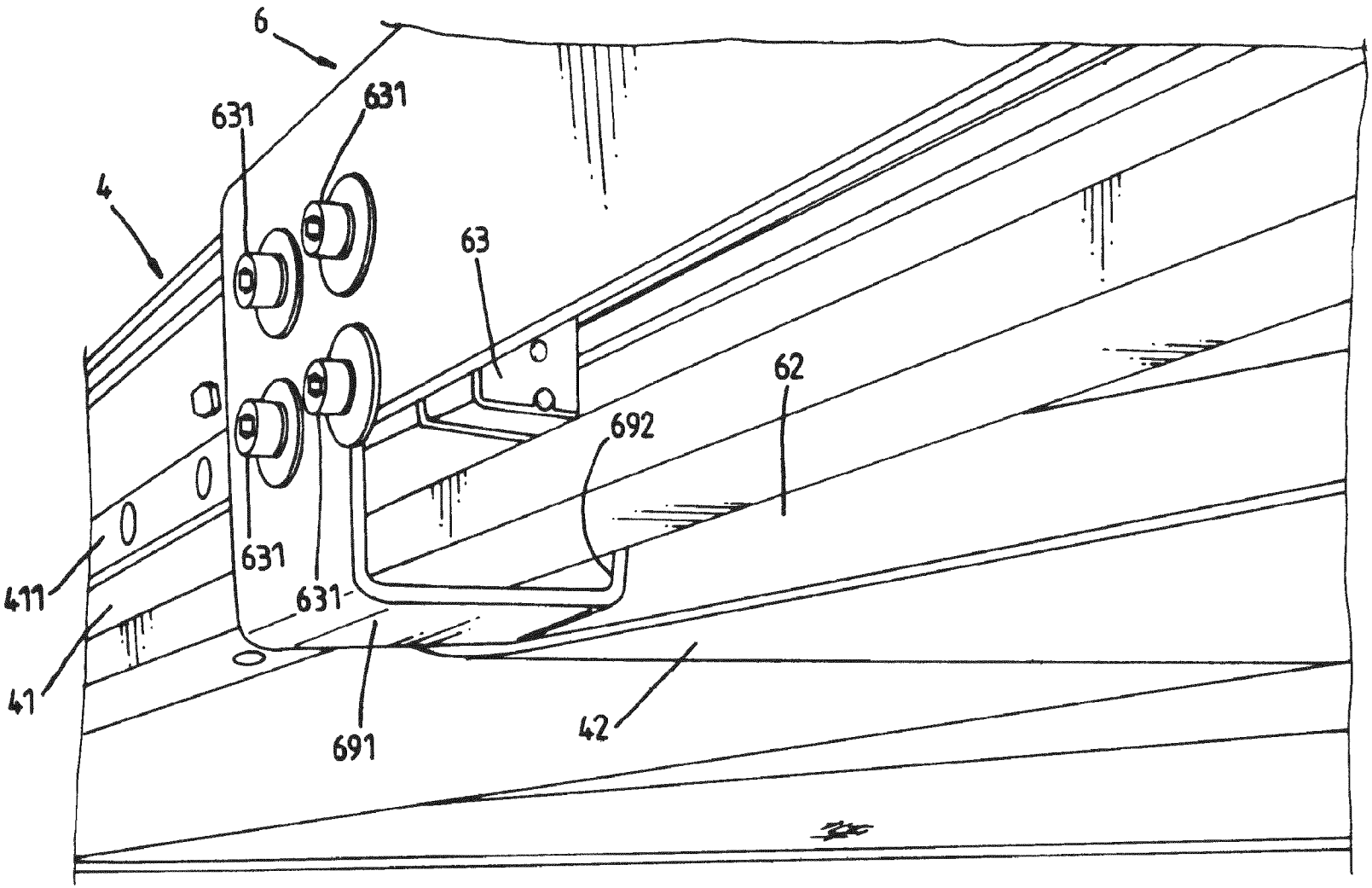
FIG. 11 is an elevational view of still part of the corrugated metal sheet member fabrication system in accordance with the present invention.

Referring to FIG. 11, the movable frames 6 each have a bottom extending plate 691. The bottom extending plate 691 has an upwardly extending inner panel 692. A pivot shaft 621 is pivotally coupled between the upwardly extending inner panels 692 of the bottom extending plates 691 of the movable frames 6 to support the rear driven roller 62 (see FIG. 15).

In conclusion, the corrugated metal sheet member fabrication system in accordance with the present invention has the following features and benefits:

1. When the reciprocating cutting-off device 31 is moved forwards or backwards, the belt frame 41 of the conveyer 4 is synchronously moved to carry the movable frames 6 forwards or backwards, and therefore the front driven roller 61 and the rear driven roller 62 with the conveying belt 42 are moved with the movable frames 6 forwards to the extended position or backwards to the retrieved position. After the movable frames 6 has been moved forwards, the front side of the conveying belt 42 is kept spaced above the base 32 for receiving finished products from the reciprocating cutting-off device 31 of the cutting unit 3 and delivering collected finished products to the finished product receiving rack 5. Therefore, the invention automatically and accurately conveys finished products from the reciprocating cutting-off device 31 of the cutting unit 3 to the finished product receiving rack 5.

2. The corrugated metal sheet member fabrication system achieves fabrication of corrugated metal sheet members automatically, ensuring accurate delivery of finished products from the reciprocating cutting-off device 31 of the cutting unit 3 to the finished product receiving rack 5 and preventing falling of finished products from the conveyer 4.

3. The position of the front driven roller 61 that is pivotally provided at the front side of the movable frames 6 is conveniently adjustable relative to the movable frames 6 to satisfy different working requirements.

While only one embodiment of the present invention has been shown and described, it will be understood that various modifications and changes could be made thereunto without departing from the spirit and scope of the invention disclosed.

What is claimed is:

1. A corrugated metal sheet member fabrication system comprising:

a material feeder, a roller-ramming unit, a cutting unit, a conveyer, and a finished product receiving rack, said material feeder being adapted to feed a metal sheet material to said roller-ramming unit, said roller-ramming unit being adapted to roller-ramming a metal sheet material into a corrugated metal sheet material, said cutting unit comprising a base having two sliding rails and a reciprocating cutting-off device supported on said base and adapted to cut each corrugated metal sheet material received from said roller-ramming unit into finished products of a predetermined size, the reciprocating cutting-off device having a bottom wall and a rear side, a screw transmission mechanism being configured to drive the reciprocating cutting-off device forwards/backwards along the two sliding rails, said conveyer comprising a belt frame and a conveying belt supported on said belt frame and adapted to deliver the finished products from said reciprocating cutting-off device to said finished product receiving rack, said reciprocating cutting-off device of said cutting unit having two sliding grooves arranged in parallel on the bottom wall thereof and respectively coupled to the two sliding rails at the base of said cutting unit, wherein:

two movable frames having rear ends are respectively slidably arranged in parallel along two opposite sides of said belt frame of said conveyer, each having a front end respectively connected to the rear side of said reciprocating cutting-off device of said cutting unit;

a front driven roller is pivotally connected between the front ends of said movable frames;

a rear driven roller is pivotally connected between the rear ends of said movable frames;

said belt frame of said conveyer has a driven roller pivotally provided at a front side thereof and spaced between the front driven roller and rear driven roller at said movable frames at an elevation above the front driven roller and rear driven roller at said movable frames;

said conveying belt of said conveyer extends over the driven roller at the front side of said belt frame, the front driven roller and rear driven roller at said movable frames, and a driving roller at a rear side of said belt frame;

a driving roller is pivotally provided at the belt frame of said conveyer and a transmission mechanism configured to rotate the driving roller to move said conveying belt in carrying the finished products from said reciprocating cutting-off device to said finished product receiving rack;

when said reciprocating cutting-off device of said cutting unit is moved forwards and backwards, said movable frames are moved synchronously, and therefore said conveying belt is moved with said movable frames forwards to an extended position and backwards to a retrieved position;

when said movable frames are moved forwards, a front side of said conveying belt is kept spaced above the base of said cutting unit for receiving the finished products from said reciprocating cutting-off device and delivering collected finished products to said finished product receiving rack.

2. The corrugated metal sheet member fabrication system as claimed in claim 1, wherein said movable frames each have a track member fixedly fastened thereto with a fastening member; said belt frame of said conveyer has two rails arranged on two opposite lateral sides thereof and respectively coupled to the track members at said movable frames.

3. The corrugated metal sheet member fabrication system as claimed in claim 1, wherein said belt frame of said conveyer is disposed above the elevation of the two sliding rails at the base of said cutting unit so that said movable frames with the front driven roller and rear driven roller at said movable frames are kept spaced above the base of said cutting unit when said conveying belt is moved with said movable frames forwards to the extended position.

4. The corrugated metal sheet member fabrication system as claimed in claim 1, wherein said belt frame of said conveyer is mounted with two brackets to support a driven roller between the driven roller at the front side of said belt frame and the driving roller at said conveyer at a relatively lower elevation to stretch said conveying belt.

5. The corrugated metal sheet member fabrication system as claimed in claim 1, further comprising two connecting members are respectively connected between said two movable frames and said reciprocating cutting-off device of said cutting unit.

6. The corrugated metal sheet member fabrication system as claimed in claim 1, wherein said movable frames each have a longitudinally extending front sliding slot, and a pivot shaft is coupled to the longitudinally extending front sliding slots of said movable frame to pivotally support said front driven roller between said movable frames and fastened with a lock nut at each of two distal ends thereof.

7. The corrugated metal sheet member fabrication system as claimed in claim 6, wherein said movable frames each have a locating block fixedly provided at an outer side and respectively mounted with an adjustment screw and a packing nut at said adjustment screw, said adjustment screw being stopped at the periphery of the lock nut at the associating movable frame, said packing nut being threaded onto the associating adjustment screw and stopped against the associating locating block.

8. The corrugated metal sheet member fabrication system as claimed in claim 1, wherein said movable frames each have a bottom extending plate, said bottom extending plate having an upwardly extending inner panel; a pivot shaft is pivotally coupled between the upwardly extending inner panels of the bottom extending plates of said movable frames to support said rear driven roller.

* * * * *